US008157465B2

(12) United States Patent
Duru

(10) Patent No.: US 8,157,465 B2
(45) Date of Patent: Apr. 17, 2012

(54) APPLICATOR AND A KIT INCLUDING SUCH AN APPLICATOR

(75) Inventor: Nicolas Duru, Paris (FR)

(73) Assignee: L'Oreal, Paris (FR)

( * ) Notice: Subject to any disclaimer, the term of this patent is extended or adjusted under 35 U.S.C. 154(b) by 1216 days.

(21) Appl. No.: 11/907,901

(22) Filed: Oct. 18, 2007

(65) Prior Publication Data

US 2008/0214970 A1 Sep. 4, 2008

Related U.S. Application Data

(60) Provisional application No. 60/863,982, filed on Nov. 2, 2006.

(30) Foreign Application Priority Data

Oct. 19, 2006 (FR) ..... 06 54380

(51) Int. Cl.
*B43K 5/12* (2006.01)

(52) U.S. Cl. ..... 401/134; 401/132

(58) Field of Classification Search ..... 401/6, 132–135
See application file for complete search history.

(56) References Cited

U.S. PATENT DOCUMENTS

| | | | | |
|---|---|---|---|---|
| 3,386,793 | A * | 6/1968 | Stanton | 401/132 |
| 3,485,562 | A * | 12/1969 | Hidden et al. | 401/134 |
| 3,754,548 | A | 8/1973 | McGrath | |
| 3,998,559 | A * | 12/1976 | Hoyt | 401/132 |
| 4,148,318 | A * | 4/1979 | Meyer | 604/3 |
| 4,291,685 | A | 9/1981 | Taelman | |
| 4,730,949 | A * | 3/1988 | Wilson | 401/132 |
| 4,858,600 | A | 8/1989 | Gross et al. | |
| 4,927,283 | A * | 5/1990 | Fitjer | 401/132 |
| 6,488,665 | B1 * | 12/2002 | Severin et al. | 604/200 |
| 7,416,358 | B2 * | 8/2008 | Legendre | 401/205 |
| 2004/0267170 | A1 | 12/2004 | Liste et al. | |

FOREIGN PATENT DOCUMENTS

| | | |
|---|---|---|
| EP | 1 175 845 A1 | 1/2002 |
| FR | 1 175 845 A | 4/1959 |
| FR | 1 314 319 | 2/1962 |
| FR | 2 595 587 A1 | 9/1987 |
| FR | 2 811 872 A1 | 1/2002 |
| FR | 2 853 820 A1 | 10/2004 |
| WO | WO 03/030807 A1 | 4/2003 |

* cited by examiner

*Primary Examiner* — Huyen Le
(74) *Attorney, Agent, or Firm* — Oliff & Berridge, PLC

(57) ABSTRACT

The present invention relates to an applicator for applying a composition to the human body, the applicator comprising: a support that is configured to be mounted in removable manner on an appliance that enables movement to be transmitted to said support; a reservoir that is secured to the support and that contains the composition, the reservoir being defined, at least in part, by at least one closure element; an applicator element that is secured to the support at least during use; and an opener element that is suitable for acting on the closure element in order to put the reservoir and the applicator element into communication.

26 Claims, 3 Drawing Sheets

APPLICATOR AND A KIT INCLUDING SUCH AN APPLICATOR

This non provisional application claims the benefit of French Application No. 06 54380 filed on Oct. 19, 2006 and U.S. Provisional Application No. 60/863,982 filed on Nov. 2, 2006.

The present invention relates to applicators and to electrical appliances for applying a composition to the skin, e.g. a cosmetic composition, including makeup.

BACKGROUND

By way of example, the composition can be a care product, a slimming agent, or a tightening agent, that is suitable for being massaged into the stomach, the bust, or the thighs.

It can also be a scrub composition for application to the face, for example.

Such a composition can contain plant extracts, amongst other compounds.

The method of applying the composition can play an important role in obtaining a satisfactory result.

Appliances that make it possible to apply compositions while exerting a massaging action are known, e.g. from U.S. Pat. Nos. 3,754,548, 4,858,600, or 4,291,685. Such appliances include a reservoir containing the composition, and are relatively complex and expensive to make.

French patent application FR 2 811 872 discloses a device for applying a composition, and including a film that is perforated by an opener member while the refill is being fastened thereto. The applicator element is displaced manually over the region to be treated.

French patent application FR 2 595 587 discloses a hand-driven applicator in which a reservoir containing the composition is opened by pressure exerted on the application surface.

French patent application FR 2 853 820 describes an applicator for positioning on a fingertip, and including a reservoir defined by a deformable bottom wall and a membrane. The bottom wall is provided with a pin that make it possible to perforate the membrane, when the user exerts pressure on the bottom wall. Once the membrane has been perforated, the composition can flow towards the applicator element.

SUMMARY

There exists a need to improve still further applicators for applying a composition to the human body, and in particular those applicators for coupling to appliances that enable said applicators to move so as to generate a massaging, spreading, smoothing, and/or skin-exfoliating action.

In one of its aspects, the invention provides an applicator for applying a composition to the human body, the applicator comprising:

- a support that is configured to be mounted in removable manner on an appliance that enables movement to be transmitted to said support;
- a reservoir that is secured to the support and that contains the composition, the reservoir being defined, at least in part, by at least one closure element, e.g. a removable and/or perforatable closure element;
- an applicator element that is secured to the support at least during use; and
- an opener element that is suitable for acting on the closure element in order to put the reservoir and the applicator element into communication.

The term "movement" should not be understood in a restrictive sense, and encompasses unidirectional or alternating movements in order to produce an abrasing and/or massaging and/or composition-spreading or -smoothing action. The term "movement" encompasses vibration transmitted to the applicator.

The opener element may be arranged to exert an opening action on the closure element when sufficient pressure is exerted on the applicator element. This simplifies preparing the applicator for use, which can be performed in quick and simple manner.

The invention makes it possible to preserve the composition in leaktight manner before first use, while making it easier to dispense the composition by means of the applicator element.

The invention makes it possible to apply the composition hygienically, since the composition does not need to be taken, nor applied, by hand.

By means of the applicator element, the invention also makes it possible to use a composition that is very fluid, where appropriate.

The reservoir may be opened by exerting pressure with the applicator element on the region to be treated, for example.

The reservoir may be defined, at least in part, by the support, at least before first use.

In a variant, the reservoir may be defined before first use by a single-use pack, e.g. in the form of a pouch, disposed inside the support.

The closure element may comprise a film that is fastened on the support, e.g. a film that is heat-sealed on the support. This makes it possible to define the reservoir in simple and low-cost manner.

The opener element may advantageously be made with the support, e.g. being molded integrally as a single piece therewith.

The opener element may be central, and it may be a single opener element where appropriate.

The opener element may be arranged to perforate the closure element when said closure element comprises a film. The term "perforate" should be broadly understood as also encompassing tearing the closure element.

The applicator may advantageously include an intermediate element between the applicator element and the closure element. By way of example, the intermediate element makes it possible to avoid the opener element exerting excessive pressure on the applicator element when said applicator element is compressed during use, thereby contributing to comfort in application.

By way of example, the intermediate element may be made of a material that is more rigid than the material of the applicator element. The presence of the intermediate element makes it possible, if so desired, to use a very flexible material to make the applicator element, thereby making it easier to match the outline of the region to be treated, for example.

The intermediate element may be fastened on the support, with the closure element optionally being interposed therebetween, possibly by means of a material bridge which, in an embodiment, may be breakable.

The intermediate element may be secured to the closure element, in particular when said closure element comprises a film fastened on the support. By way of example, the intermediate element may be heat-sealed or bonded on the film.

The intermediate element may be in the form of a disk having a central hole for receiving the opener element once the closure element has been opened, e.g. perforated, and the intermediate element has been pressed into the support.

The intermediate element may be mounted with the possibility of moving relative to the support, so as to be able to exert pressure, during use, on the closure element, tending to reduce the inside volume of the reservoir. This can contribute to improving the amount of composition that can be recovered.

The movement of the intermediate element may be partial, e.g. when the intermediate element is held axially at its periphery relative to the support, in which event only a central portion of the intermediate element can be moved significantly relative to the support.

The movement of the intermediate element may also be overall, e.g. when the intermediate element is not fastened directly to the support and can be slidably displaced at its periphery relative to the support while it is in use, e.g. while the reservoir is being opened.

In an embodiment, the support includes a peripheral skirt and the intermediate element is fastened on the end of the peripheral skirt. The intermediate element may come to bear axially on the end of the skirt, possibly via the closure element. In a variant, the intermediate element may be displaced along the axis of the peripheral skirt, being guided by said skirt. It is possible for there to be no leaktight co-operation between the intermediate element and the support, and the composition that flows through a gap between the two can be absorbed by the applicator element.

The outside section of the intermediate element and/or of the applicator element may correspond substantially to the inside section of the peripheral skirt of the support.

In particular, the intermediate element may present an outside diameter that corresponds substantially to the inside diameter of the peripheral skirt, or that is slightly greater.

When the intermediate element and/or the applicator element is pressed, in overall manner, into the support, said support may present a portion in relief over which the intermediate element and/or the applicator element pass by deforming elastically during said depression, which portion in relief then participates in holding the intermediate element and/or the applicator element on the support.

The closure element may comprise an optionally-stretchable film.

When a stretchable film is used, said film may stretch to match the shape of the support and reduce the volume of the reservoir when pressure is exerted on the applicator element. The film may be stretchable in optionally-reversible manner.

When the film is not stretchable, the film may possibly deform or tear when pressure is exerted on the applicator element.

Where appropriate, the film may be fastened on the support with the possibility of deforming without excessive stretching, by means of one or more folds enabling the film to unfurl.

The film may comprise a layer of metal, e.g. of aluminum, in order to improve the preservation of the composition and/or make it easier to heat-seal the film on the support, for example. The support may comprise a plurality of layers of different materials laminated together.

The support may include a peripheral skirt, as mentioned above. The peripheral skirt may cover the applicator element in part, at least once the closure element has been opened. The skirt may participate in holding the applicator element on the applicator, where appropriate, and it may prevent said applicator element from turning relative to the support. The support may also include a torque-transmitting projection, such as a pin that is engaged in a corresponding recess of the intermediate element and/or of the applicator element.

The peripheral skirt may have a shape that is not circularly symmetrical, in order to enable torque to be transmitted to the applicator element, where appropriate.

The axial dimension of the peripheral skirt may, at rest, be less than or equal to the thickness of the applicator element. The thickness of the applicator element is preferably sufficiently thick to ensure that, during use, the peripheral skirt does not come into contact with the region being treated, thereby avoiding any risk of discomfort.

The reservoir may be radially defined by the above-mentioned peripheral skirt.

The support may include a spindle for co-operating with the appliance. The spindle may be molded integrally as a single piece with the support. Where appropriate, the spindle may be fluted, or it may include any other shape that effectively transmits torque.

The support may be arranged to be fastened by snap-fastening onto the appliance. Where appropriate, said appliance may include an ejector member for ejecting the applicator.

The applicator element may be fastened on the intermediate element and need not be fastened directly on the support.

The applicator element may be elastically deformable, and may, for example, include a material that is porous and/or permeable to the composition, e.g. a foam, in particular having open or half-open cells, a sintered element, a felt, or a flocked endpiece.

Where appropriate, the applicator element may include natural passages that define its porosity or permeability and/or passages that have been made artificially, e.g. by piercing or while the applicator element was being molded.

The applicator element may thus include at least one hole, in particular at the center or in the proximity of the center, making it easier for the composition to flow over the application surface.

The applicator element may present a composite structure, e.g. including a woven or non-woven fabric on the surface.

On the application surface, the applicator element may present portions in relief such as bumps.

The applicator may include a plurality of opener elements, in which event the intermediate element may include a plurality of associated holes, for example. This can make it easier to dispense the composition towards the applicator element. All of the opener elements may be made integrally as a single piece with the support by molding.

The applicator may include a removable cover that is suitable for being fastened on the support or the appliance. By way of example, this makes it possible to avoid the applicator element drying out between two uses, where appropriate.

The support may present a symmetrical shape that is optionally circularly symmetrical.

The support may be rigid, i.e. does not visibly deform during use. This can make it easier to transmit torque or vibration to the applicator element.

On the side remote from the applicator element, the support may include a rigid bottom wall.

The applicator may be contained in hermetically-sealed packaging before it is mounted on the appliance.

The opener element may be fixed relative to the support.

The pressure which tends to press the closure element into the reservoir may result from a force exerted, for example along an axis of the opener element, on the surface of the applicator element which is intended to be in contact with the surface to be treated.

In particular, this pressure may be exerted without any movement of rotation of the support and/or the opener element and/or the applicator element relative to the closure element.

The opener element may be in contact with the composition in the reservoir at least before the opening of this reservoir.

The invention also provides a kit comprising an applicator as defined above, and an appliance that enables movement to be transmitted to said applicator. Where appropriate, the kit proposed to the consumer comprises an appliance and a plurality of applicators which may optionally be identical and may optionally contain the same composition.

The invention also provides a cosmetic treatment using an applicator or an appliance as defined above.

The treatment may comprise the steps consisting in:

exerting pressure on the applicator element in such a manner as to cause the reservoir to be opened; and applying the applicator element to keratinous materials, the applicator element being secured to an appliance that enables movement to be transmitted to said applicator element.

In another of its aspects, and independently or in combination with the above, the invention also provides an applicator for applying a composition to the human body, the applicator comprising:

a support making it possible hold the applicator;

a reservoir defined, at least in part, by the support and by a closure element that is fastened on the support;

an opener element that is in contact with the composition in the reservoir;

an applicator element;

an intermediate element that is fastened on the support and on which there is fastened the applicator element, said applicator element and the intermediate element being made of different materials; and the reservoir being opened by exerting pressure on the applicator element, the pressure being transmitted to the closure element and causing the opener element to exert an opening action.

The intermediate element may be in the form of a washer that is made of a material that is more rigid than the material of the applicator element.

The closure element may comprise a film that is fastened on the support, in particular fastened on a peripheral skirt of said support. The film need not be stretchable.

The opener element may be made integrally as a single piece with the support by molding.

The opener element may project from the bottom of the reservoir and may be in the form of a cone-shaped projection.

The applicator may include an intermediate element that is fastened on the closure element and/or on the support, outside the reservoir. The applicator element may be fastened on the intermediate element. The intermediate element may include a recess for receiving the opener element once the closure element has been opened, once pressure has been exerted on the applicator element.

In particular, the intermediate element may be in the form of a washer that may be made of a material that is different from the material of the applicator element, in particular that is more rigid, and that may be fastened on a peripheral skirt of the support.

Such an applicator is not necessarily designed to be fastened on an appliance for transmitting movement to said applicator.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
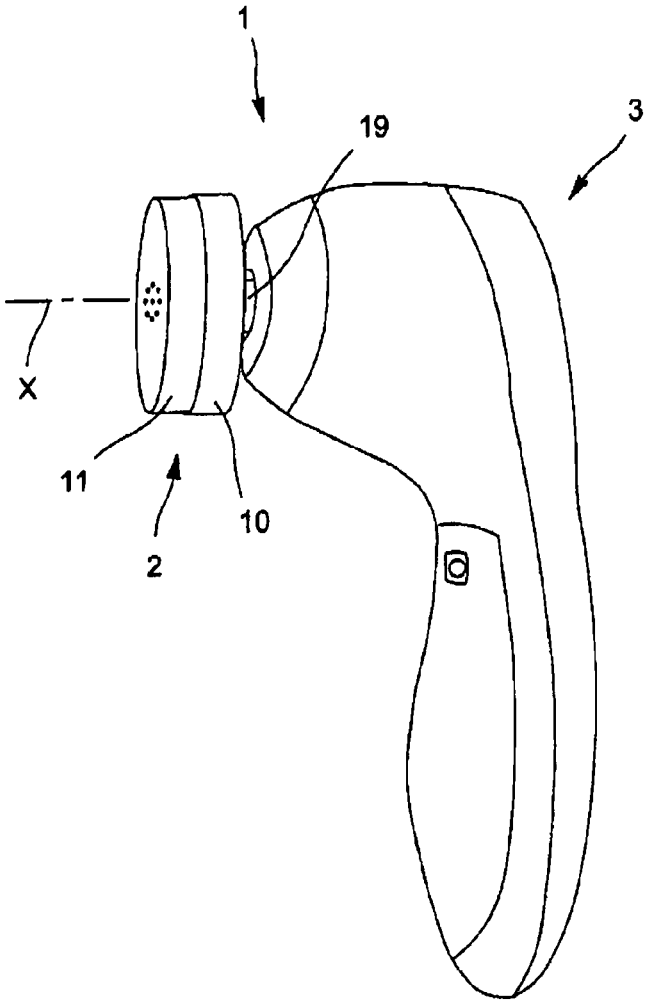
FIG. 1 is a diagrammatic perspective view of an example of a kit made in accordance with the invention.

The kit 1 shown in FIG. 1 comprises an applicator 2 and an appliance 3 that enables movement to be transmitted to the applicator 2, e.g. rotary movement about an axis X or some other movement.

By way of example, the appliance 3 can be arranged to transmit a vibration movement to the applicator, along the axis X of the applicator 2 or transversally to said axis.

The appliance 3 can also be arranged to transmit an off-center rotary movement to the applicator 2, the path of a point of the applicator being an epicycloid, for example.

The appliance 3 can also be arranged to transmit both vibration and a continuous rotary and/or translation movement to the applicator 2.

The amplitude of the movement and/or vibration transmitted by the appliance 3 to the applicator 2 can be fixed or adjustable, the appliance 3 possibly having control means enabling the user to vary the amplitude, e.g. a cursor or a button or one or more control keys.

The appliance 3 can include an ON/OFF switch.

The appliance 3 can be designed to run on optionally-rechargeable batteries or on the mains.

Initially, the appliance 3 can be contained in a case with at least one applicator 2, said applicator possibly being packaged separately, where appropriate.

In the embodiment under consideration, the applicator 2 can be fastened in removable manner on the appliance 3 so as to enable said applicator to be replaced once its dose of composition has run out.

By way of example, the quantity of composition contained in the applicator 2 corresponds to a single use, for treating the face or the body.

By way of example, the quantity lies in the range 1 milliliter (mL) to 10 mL, e.g. about 3 mL.

Various coupler means for coupling the applicator 2 and the appliance 3 can be envisaged, the appliance 3 possibly including, where appropriate, a locking member for locking the applicator 2, said locking member being actuated by the user so as to avoid the applicator 2 becoming accidentally detached, and/or an ejector member for ejecting the applicator 2.

In the embodiment shown, the applicator 2 includes a spindle 19 that enables it to be coupled to a drive shaft of the appliance 3, not shown in FIG. 1.

Figure 4:
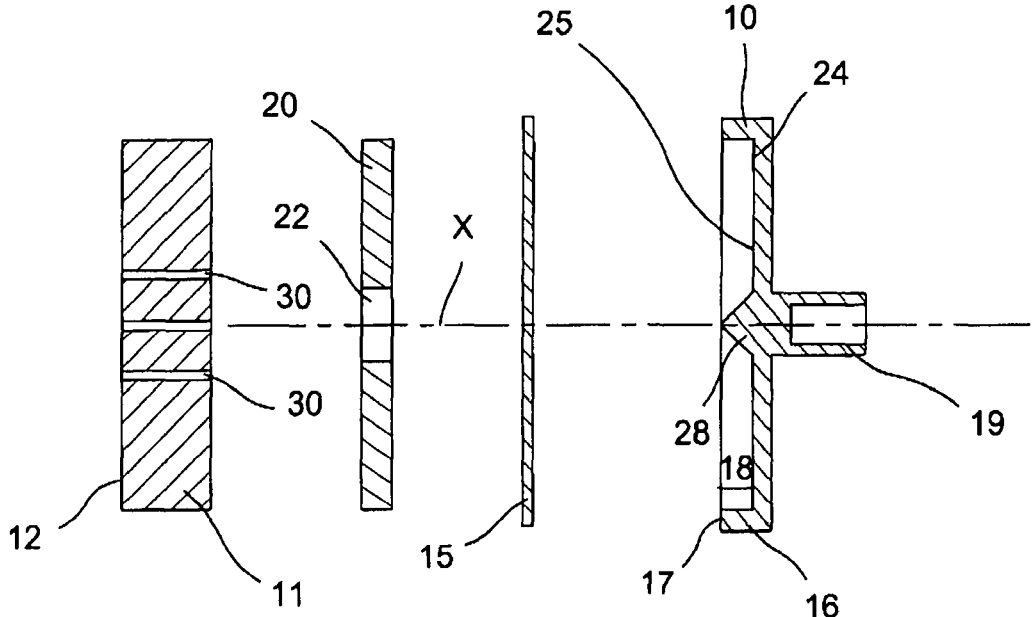
FIG. 4 is an exploded axial section of the applicator.

The spindle 19 can be hollow, as shown in FIG. 4, with a non-circular cross section suitable for transmitting torque effectively, for example.

The applicator 2 includes a support 10 that is, for example, made by molding a relatively rigid thermoplastic material, e.g. polypropylene, acrylonitrile butadiene styrene (ABS), or polyurethane.

In the embodiment under consideration, the spindle 19 is connected to the support 10, and is made integrally as a single piece with said support.

The applicator 2 includes an applicator element 11 that defines an application surface 12 for coming into contact with the region to be treated, e.g. a portion of the skin; the lips; or the hair.

The support 10 includes a transverse bottom wall 24 that extends generally transversally to the axis X, and on which a peripheral skirt 16, of axis X, is connected on the side remote from the spindle 19.

Together with the peripheral skirt 16 and a closure element 15, the transverse wall 24 defines a reservoir 18 that contains the composition for application.

In the embodiment under consideration, the closure element 15 is a film that is heat-sealed on the end face 17 of the skirt 16.

The closure element 15 is a film of thickness lying in the range 0.03 millimeters (mm) to 0.2 mm, for example. The film can optionally be stretchable, and it can, for example, tear progressively. By way of example, the film is an aluminum sheet having a thickness of 0.05 mm.

In the embodiment shown, the applicator 2 includes an intermediate element 20 between the applicator element 11 and the closure element 15.

In the embodiment under consideration, the intermediate element 20 is in the form of a washer having an outside diameter that corresponds substantially to the inside diameter of the peripheral skirt 16, and having a hole 22 passing through its center.

By way of example, the intermediate element 20 is bonded or heat-sealed on the closure member 15.

Where appropriate, the intermediate element 20 can be heat-sealed, bonded, or fastened by some other means on the support 10. Thus, the intermediate element can be fastened on the end face 17 of the skirt 16 via the film 15 when the intermediate element presents an outside diameter that is greater than the inside diameter of the skirt 16.

Figure 9:
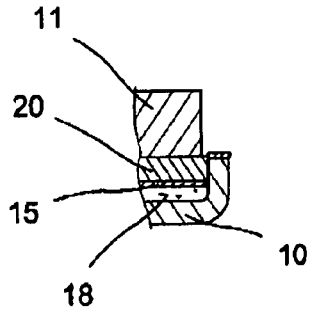
FIGS. 5 to 10 show embodiment details.

When the intermediate element 20 presents an outside diameter that corresponds substantially to the inside diameter of the peripheral skirt 16, the intermediate element 20 can bear tightly against the inside surface of the peripheral skirt 16, once the reservoir 18 has been opened, as shown in FIG. 9. The closure element can tear all along the inner periphery of the peripheral skirt 16. The composition contained in the reservoir can participate, where appropriate, in holding the intermediate element in the support by adhesion.

Depending on the variant, the intermediate element 20 can optionally be engaged in the support 10 during use.

In a variant that is not shown, the intermediate element 20 and the closure element 15 are made integrally as a single piece by molding.

In the bottom of the reservoir 18, on the inside face 25 of the transverse wall 24, the support 10 includes an opener element 28 for perforating the closure element 15 when pressure is exerted on the applicator element 11, tending to press the closure element 15 into the reservoir 18.

The hole 22 of the intermediate element 20 is situated facing the opener element 28 so as to enable the opener element to become engaged in the hole 22 once the closure element 15 has been perforated.

In the embodiment under consideration, the opener element 28 is in the form of a cone-shaped projection, centered on the axis X, and having a tip that is situated substantially at the height of the end face 17 of the peripheral skirt 16.

In the embodiment shown, the applicator element 11 includes a plurality of holes 30 that encourage the composition to reach the application surface 12, once the closure element 15 has been opened. By way of example, the holes 30 are made in the central region of the applicator element.

The applicator element 11 can be bonded or heat-sealed on a face of the intermediate element 20, which can itself be bonded or heat-sealed via its opposite face on the closure element 15, as mentioned above.

The thickness of the intermediate element 20 is preferably sufficient for the tip of the opener element 28 not to extend beyond the hole 22 of the intermediate element 20, even in the event of relatively large amount of pressure being exerted by the user with the applicator 2 on the region to be treated, and this avoids any risk of injury.

By way of example, the thickness of the intermediate element 20 is greater than or equal to the axial dimension of the opener element 28.

In a variant not shown, the hole 22 can be replaced by a recess having a shape that substantially matches the shape of the opener element 28, for example.

In order to use the kit 1, the user puts the applicator 2 into place on the appliance 3, then exerts sufficient pressure on the applicator element 11 to perforate the closure element 15 and to enable the composition contained in the reservoir 18 to reach the application surface 12.

A small amount of pressure on the applicator can press the intermediate element 20 into the support 10, and, by controlling the amount of pressure exerted, the user can measure out the quantity of composition that is delivered on the application surface 12.

The invention is not limited to a particular composition being contained in the reservoir 18, and said composition can be a liquid, a gel, or a paste, for example, for use as makeup or a care product.

The amount of composition that can be recovered can be relatively high when the intermediate element 20 can come to press the closure element 15 against the transverse wall 24. The degree to which the intermediate element 20 is pressed into the support 10 between the start of use and the reservoir being emptied as much as possible lies, for example, in the range 3 mm to 20 mm, e.g. about 7 mm, depending on the size of the applicator and the initial volume of composition.

Naturally, the invention is not limited to the embodiment shown in FIGS. 1 to 4.

By way of example, the support 10 could include a plurality of opener elements in order to encourage the flow of composition towards the applicator element, and, in this event, the intermediate element 20 could thus include a plurality of corresponding recesses.

The shape of the opener element could be modified, and it is possible, for example, to use a pin or a projection that is pyramid-shaped or beveled, or of any other shape that is suitable for opening the closure element.

The closure element could be made of a plastics material or of metal or of any other perforatable or tearable material. Where appropriate, the closure element 15 could be made with a zone of weakness, making it easier to open at a predefined location.

Figure 5:
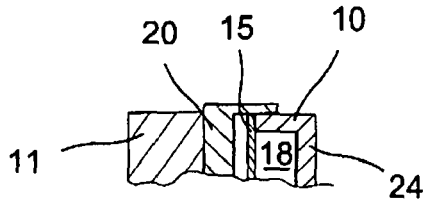

In the variant shown in part in FIG. 5, the intermediate element 20 co-operates in leaktight manner with an outside surface of the support 10, for example, coming to cover the peripheral skirt 16 at least in part, for example.

The intermediate element could also be made integrally as a single piece with the applicator element.

Figure 6:
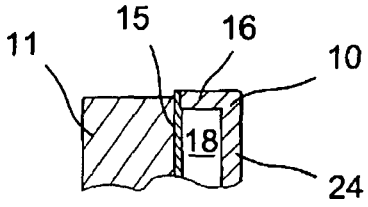

In the variant shown in part in FIG. 6, the intermediate element is absent and the applicator element 11 comprises a foam, for example, made of a material that is sufficiently thick and/or resistant to compression to ensure that, in the event of the user exerting pressure on the applicator element 11 during application, the opener element 28 does not exert pressure on the user that might harm the user. In such a variant, the applicator element could optionally be made with a recess for receiving the opener element. Where appropriate, the applicator element 11 could cover, at least in part, the end of the peripheral skirt 16, as shown in the figure.

The shape of the support could be modified, and said support could present a shape that is not circularly symmetrical, for example, with a peripheral skirt that is not circularly cylindrical or that includes one or more portions in relief to prevent turning, for example.

The applicator element could also present a shape that is not circularly symmetrical, so that the co-operation of shapes between the applicator element and the support contributes to torque being transmitted between the support and the applicator element, when the support is for being turned by the appliance.

Where appropriate, the support could include portions in relief that co-operate with the applicator element and/or with the intermediate element in order to transmit torque.

Figure 10:
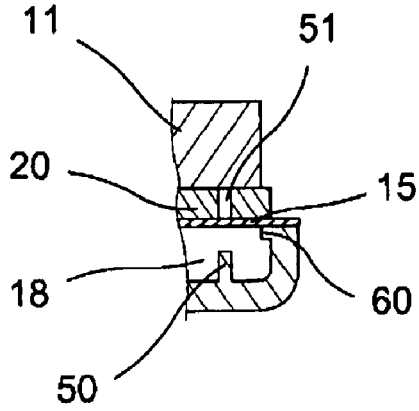
Figure 3:
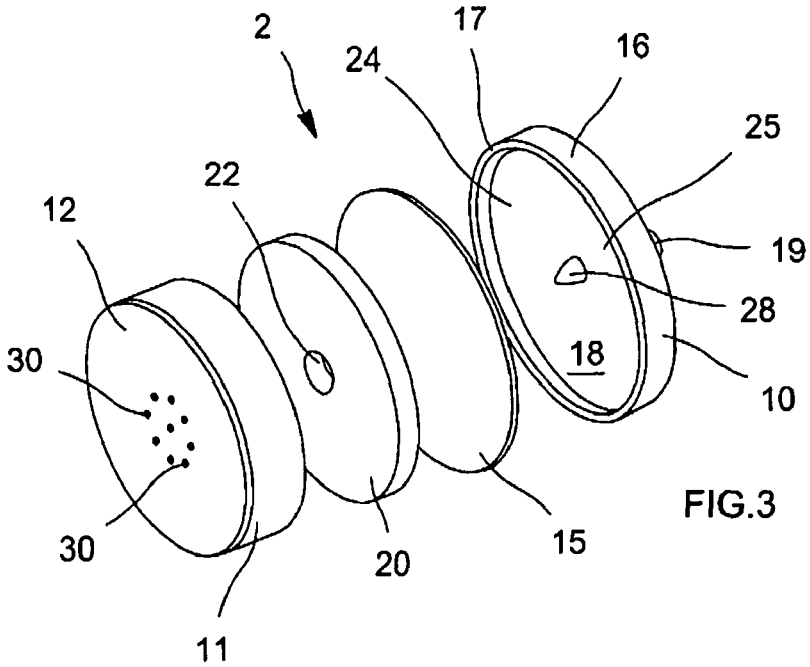
FIG. 3 is an exploded perspective view of the FIG. 2 applicator.

In particular, the support could include a pin 50 for transmitting torque to the intermediate element and/or to the applicator element, as shown in FIG. 10.

Figure 7:
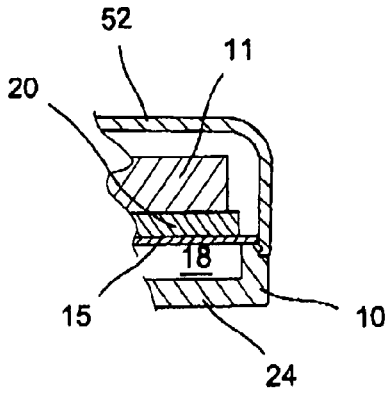
Figure 8:
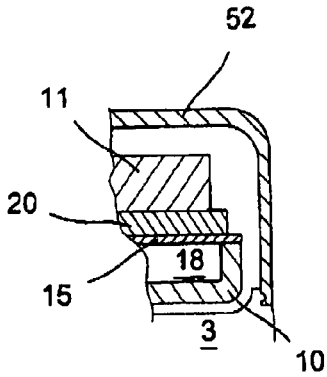
Figure 2:
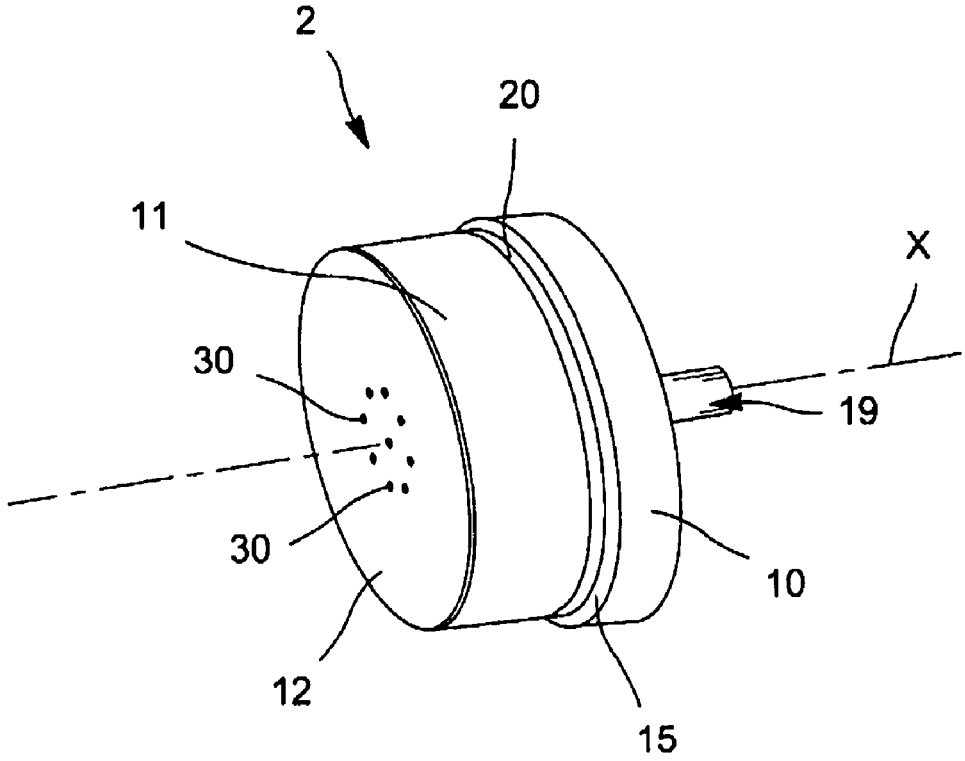
FIG. 2 is a perspective view showing the FIG. 1 applicator in isolation.

By way of example, the pin 50 is received in a corresponding hole 51 of the intermediate element while the applicator is being used.

Where appropriate, the applicator could include a protective cover 52 that comes to be fastened on the support, as shown in part in FIG. 7. In a variant, the protective cover could be fastened on the appliance 3, as shown in FIG. 8. The cover could close the applicator, optionally in leaktight manner, depending on whether it is desired to avoid the composition drying out on the applicator element.

FIG. 8 shows the possibility of the intermediate element covering, at least in part, the peripheral skirt of the support.

In the variant shown in FIG. 10, the support 10 is made with a portion in relief 60 over which the intermediate element can pass by deforming elastically while the reservoir is being opened. The portion in relief 60, which is a rib or a tooth, can participate in holding the intermediate element on the support after the closure element has been ruptured.

In variants that are not shown and that correspond to another aspect of the invention, the support is made without a coupling member for coupling to an appliance, the applicator being moved purely manually over the region being treated.

The expression "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An applicator for applying a composition to the human body, the applicator comprising:

a support that is configured to be mounted in removable manner on an appliance that enables movement to be transmitted to said support;

a reservoir that is secured to the support and that contains the composition, the reservoir being defined, at least in part, by at least one closure element;

an applicator element that is secured to the support at least during use; and an opener element that is suitable for acting on the closure element in order to put the reservoir and the applicator element into communication, the opener element being arranged to exert an action on the closure element when enough pressure, tending to press the closure element into the reservoir, is exerted on the applicator element;

the support including a spindle for co-operating with the appliance, and extending perpendicular to an applicator surface of the applicator element.

2. An applicator according to claim 1, the closure element comprising a film that is fastened on the support.

3. An applicator according to claim 2, the support including a peripheral skirt having an end face on which the film is heat-sealed.

4. An applicator according to claim 1, the opener element being made with the support.

5. An applicator according to claim 4, the opener element being central.

6. An applicator according to claim 5, the opener element being a single opener element.

7. An applicator according to claim 1, including an intermediate element between the applicator element and the closure element.

8. An applicator according to claim 7, the intermediate element being held axially at its periphery relative to the support.

9. An applicator according to claim 7, the intermediate element being suitable for being displaced at its periphery relative to the support.

10. An applicator according to claim 7, the intermediate element being in the form of a washer.

11. An applicator according to claim 7, the support including a peripheral skirt, and the intermediate element coming to bear axially on the end of the skirt.

12. An applicator according to claim 7, the intermediate element being made of a material that is harder than the material of the applicator element.

13. An applicator according to claim 7, the applicator being fastened on the intermediate element, which is itself fastened on the closure element.

14. An applicator according to claim 1, the support including a peripheral skirt.

15. An applicator according to claim 14, the peripheral skirt covering the applicator element in part, at least once the closure element has been opened.

16. An applicator according to claim 14, the axial dimension of the peripheral skirt being, at rest, less than or equal to the thickness of the applicator element.

17. An applicator according to claim 1, the spindle being molded integrally as a single piece with the support.

18. An applicator according to claim 1, the applicator element including one or more holes.

19. An applicator according to claim 1, the applicator element being elastically deformable.

20. An applicator according to claim 1, the applicator element including a foam having open or half-open cells.

21. An applicator according to claim 1, including a removable cover that is suitable for being fastened on the support or the appliance.

22. An applicator according to claim 1, the applicator element being prevented from turning relative to the support.

23. An applicator according to claim 1, wherein the opener element is in the bottom of the reservoir.

24. A cosmetic treatment method using an applicator comprising:

a support that is configured to be mounted in removable manner on an appliance that enables movement to be transmitted to said support;

a reservoir that is secured to the support and that contains the composition, the reservoir being defined, at least in part, by at least one closure element;

an applicator element that is secured to the support at least during use; and an opener element that is suitable for acting on the closure element in order to put the reservoir and the applicator element into communication, the opener element being arranged to exert an action on the closure element when enough pressure, tending to press the closure element into the reservoir, is exerted on the applicator element;

the support including a spindle for co-operating with the appliance, and extending perpendicular to an applicator surface of the applicator element;

the treatment method comprising:

exerting pressure on the applicator element in such a manner as to cause the reservoir to be opened; and applying the applicator element to keratinous materials, the applicator element being secured to an appliance that enables movement to be transmitted to said applicator element.

25. An applicator for applying a composition to the human body, the applicator comprising:

a support making it possible hold the applicator, and including a bottom wall;

a reservoir defined, at least in part, by the support and by a closure element that is fastened on the support;

an opener element that is in contact with the composition in the reservoir before the opening of the reservoir; and an applicator element, the reservoir being opened by exerting pressure on the applicator element without substantially deforming the bottom wall, the pressure being transmitted to the closure element and causing the opener element to exert an opening action;

the support including a spindle for co-operating with an appliance, and extending perpendicular to an applicator surface of the applicator element.

26. A kit comprising:

an applicator for applying a composition to the human body, the applicator comprising:

a support that is configured to be mounted in removable manner on an appliance that enables movement to be transmitted to said support;

a reservoir that is secured to the support and that contains the composition, the reservoir being defined, at least in part, by at least one closure element;

an applicator element that is secured to the support at least during use; and an opener element that is suitable for acting on the closure element in order to put the reservoir and the applicator element into communication;

an appliance that enables movement to be transmitted to said support, the support including a spindle for co-operating with the appliance, and extending perpendicular to an applicator surface of the applicator element.

* * * * *